United States Patent [19]

Klomp

[11] 4,014,300

[45] Mar. 29, 1977

[54] RICH-CORE STRATIFIED CHARGE SPARK IGNITION ENGINE WITH RICH MIXTURE SCOOP

[75] Inventor: Edward D. Klomp, Mount Clemens, Mich.

[73] Assignee: General Motors Corporation, Detroit, Mich.

[22] Filed: Dec. 1, 1975

[21] Appl. No.: 636,748

[52] U.S. Cl. ..... 123/30 C; 123/30 A; 123/32 SA; 123/32 SP; 123/32 ST; 123/75 B

[51] Int. Cl.[2] ..... F02B 17/00; F02B 31/02

[58] Field of Search ..... 123/75 B, 32 SA, 32 SP, 123/32 ST, 30 C, 30 R, 30 A

[56] References Cited

UNITED STATES PATENTS

| | | | |
|---|---|---|---|
| 2,058,487 | 10/1936 | Mock | 123/32 SA |
| 2,483,288 | 9/1949 | Malin | 123/30 C |
| 3,192,912 | 7/1965 | Stumpfig | 123/30 A |
| 3,318,292 | 5/1967 | Hideg | 123/32 ST |

*Primary Examiner*—Douglas Hart
*Attorney, Agent, or Firm*—Robert J. Outland

[57] ABSTRACT

Creation of a swirling stratified air-fuel charge in an engine combustion chamber is aided by a curved vane or scoop fixedly mounted on the cylinder end and arranged to divide the vortex gas flow introduced through the intake passage into segregated peripheral and core portions. The scoop may also serve as a fuel vaporizing surface and collector for surface quench products. Various arrangements are disclosed for forming a rich mixture in the central core portion adjacent the spark plug to provide the ignition and combustion advantages of a stratified charge.

3 Claims, 6 Drawing Figures

RICH-CORE STRATIFIED CHARGE SPARK IGNITION ENGINE WITH RICH MIXTURE SCOOP

This invention relates to internal combustion engines and more particularly to stratified charge spark ignition engines wherein air-fuel mixtures in the engine combustion chambers are formed with varying degrees of richness in separated zones of the combustion chambers under at least some engine operating conditions.

It is known in the art relating to spark ignition internal combustion engines to provide means for forming in the engine combustion chambers an air-fuel charge having a variation in mixture strength between various zones of the chamber. Numerous arrangements for stratified charge engines have been proposed and utilized with varying degrees of success, but few, if any, have provided sufficiently satisfactory operation under the desired range of engine operating conditions to have met with any significant degree of commercial success. Among the problems that have existed in prior stratified charge engines is a difficulty of providing adequate segregation between the rich and lean zones in the combustion chambers under various engine operating conditions in a way that efficient operation is possible throughout the engine load range.

The present invention provides spark ignition stratified charge engine arrangements in which means are provided for aiding the segregation of rich and lean mixtures in vortical flow, rich-core stratified charge combustion chambers. In some of its embodiments, the invention is related to the vortex chamber stratified charge engine arrangement disclosed in my copending U.S. patent application Ser. No. 548,683 filed Feb. 10, 1975 and assigned to the assignee of the present invention.

The present invention differs, however, in that it provides a rich mixture scoop or vane to aid in dividing the central core of rich mixture from the peripheral annulus of lean mixture or air formed as part of the stratified charge. The rich mixture scoop is stationary, being secured to or formed as part of the engine cylinder head, or other member, forming the end of the cylinder.

In some embodiments of the invention, the mixture scoop has the additional function of providing a hot surface for the evaporation of liquid fuel sprayed directly on the inner surface of the scoop or vane. The scoop may also provide a means for collecting hydrocarbon-rich surface quench products from the rich mixture zone and reducing their escape through the exhaust valve during the exhaust stroke.

These and other features and advantages of the invention will be more fully understood from the following description of certain preferred embodiments taken together with the accompanying drawings.

Figure 1:
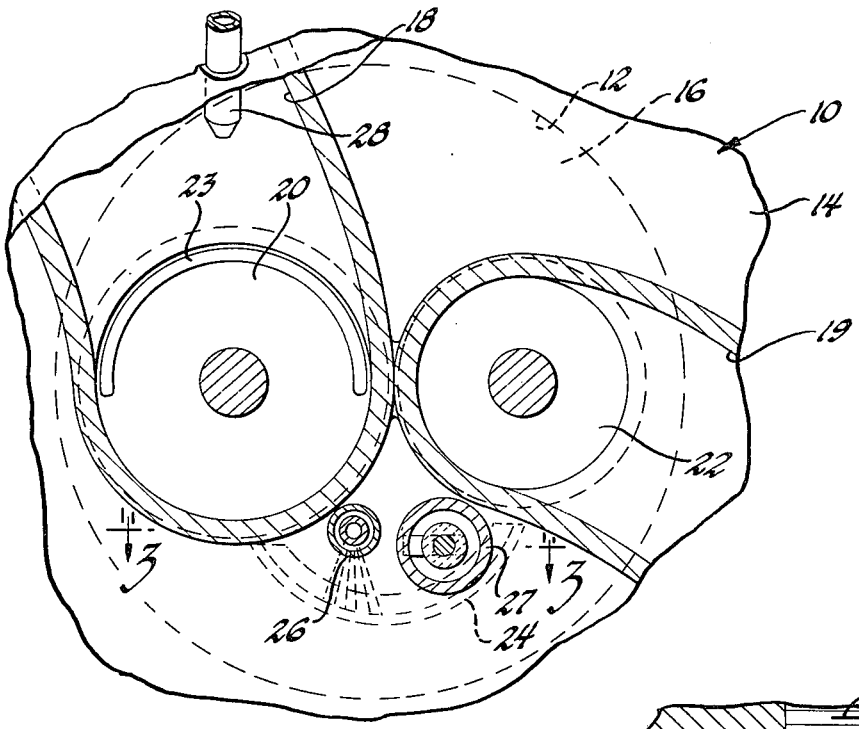
FIG. 1 is a cross-sectional view of a portion of an internal combustion engine formed according to the invention and showing the arrangement of the intake and exhaust passages, as well as certain features of the engine combustion chamber.
Figure 3:
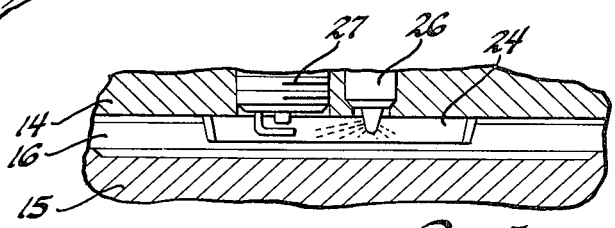
FIG. 3 is a partial cross-sectional view through the combustion chamber of the engine of FIGS. 1 and 2.
Figure 2:
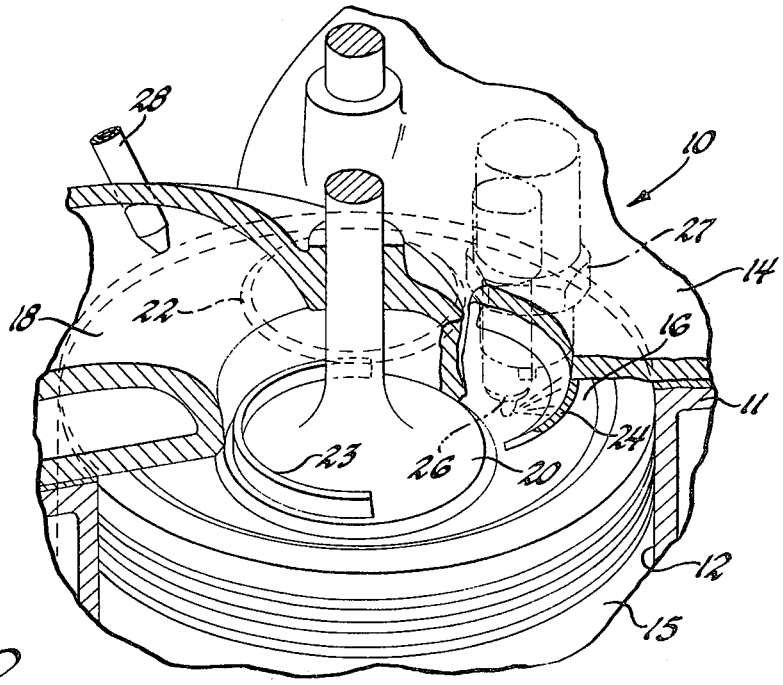
FIG. 2 is a cutaway pictorial view of the engine of FIG. 1, illustrating the arrangement of the engine combustion chamber.

Referring now particularly to FIGS. 1–3 of the drawings, there is shown a spark ignition internal combustion engine generally indicated by numeral 10. Engine 10 has a cylinder block 11 which defines internally thereof a plurality of cylinders 12, only one of which is illustrated. A cylinder head 14 is mounted on the cylinder block, closing the ends of the cylinders in conventional manner. Each of the cylinders has a piston 15 reciprocably disposed therein, which cooperates with the cylinder head and cylinder walls to define a combustion chamber 16 at the closed end of its respective cylinder.

The engine cylinder head 14 is provided with intake and exhaust ports 18, 19, opening to each combustion chamber 16 and respectively providing for the admission of air to and the exhaust of gases from the combustion chambers. The ports 18, 19 are respectively provided with intake and exhaust poppet valves 20, 22, which are adapted to control the opening and closing of the ports in conventional manner.

The intake port 18 and valve 20 are so positioned and formed as to direct incoming air or air-fuel charges into the combustion chamber 16 in a circular or vortex pattern, which moves counter-clockwise around the axis of the cylinder as viewed in FIG. 1. The intake valve 20 is preferably provided with a shroud 23 that blocks a part of the port opening and aids in directing the inlet gas flow in the counter-clockwise vortical pattern.

The cylinder head is also provided with a curved vane or mixture scoop 24, which extends downwardly from the lower surface of the cylinder head and horizontally in a curve that is generally, though not exactly, parallel to the cylinder walls and intermediate these walls and the axis of the cylinder. The scoop is positioned on the side of the intake port, toward which the incoming gas is directed and extends from adjacent the edge of the intake port to a position near the edge of the exhaust port. In cross section, the vane is preferably slanted inwardly toward the center of the cylinder for reasons which will be subsequently made clear.

Within the cylinder head, there are mounted a fuel injector 26 and a spark plug 27, both extending into the combustion chamber 16 inwardly of the vane 24. The fuel injector is preferably mounted in a position from which it can spray liquid fuel directly on the inner surface of the scoop or vane 24 for vaporization. The spark plug 27 is preferably disposed inwardly of and preferably relatively close to the scoop, in a position where the vaporized fuel from the surface of the scoop will pass by the spark plug electrode shortly after its vaporization. The engine is preferably also provided with means for supplying to, or providing in, the intake port 18 a lean air-fuel mixture for delivery to the combustion chamber. A conventional carburetor may be utilized for this purpose; however, it is equally suitable to provide other means, such as the fuel injector 28, illustrated in the drawings.

In operation of the engine of FIGS. 1–3, the intake stroke of the piston draws a charge of air or lean air-fuel mixture into the combustion chamber. Because of the shape and positioning of the intake port 18 and the valve shroud 23, the charge is directed in a vortical motion clockwise around the cylinder, as viewed in FIG. 1. As the piston moves upwardly on the compression stroke, fuel is sprayed by injector 26 onto the inner surface of the vane 24. The fuel immediately begins to vaporize, since the vane is at an elevated temperature due to its position within the combustion chamber. The vaporizing fuel mixes with the air or lean mixture, passing along the inner surface of the vane, to form a rich mixture which is directed by the vane in a curving pattern, thereby tending to hold the richened mixture in the central core portion of the combustion chamber, while the annular peripheral portion of the cylinder contains primarily air or a lean mixture as supplied from the intake port 18.

At the desired time, the spark plug 27 is fired, igniting the rich mixture in the core portion of the cylinder. The burning of the rich mixture in the central combustion chamber portion increases the chamber temperature sufficiently to also burn leaner mixtures in the peripheral portion of the combustion chamber, providing for substantially complete combustion, as is desired in stratified charge engine arrangements. Maintaining the rich mixture in the center of the cylinder provides the additional advantage that there is less likelihood of fuel vapors being quenched by contact with or adjacency to the cylinder walls, as is known to occur in conventional engine arrangements. Thus, the residual levels of hydrocarbons remaining in the cylinder after each combustion phase are likely to be lower than in conventional non-stratified engines.

The inward directional slant of the mixture scoop 24 helps to maintain liquid fuel along the inner surface of the vane until it is vaporized and mixes with the swirling air charge in the center core of the cylinder. Thus, the shape of the vane helps maintain the desired stratification of the charge within the cylinder. In addition, the fact that it extends from the intake port in curved fashion around the spark plug and fuel injector helps to direct the incoming charge from the intake port in the desired swirling vortical pattern.

For operation at or near maximum load conditions, it is desirable that the mixture in the total combustion chamber be enriched to form a more homogeneous air-fuel mixture. This may be accomplished in various ways. If desired, the total fuel may be injected by the cylinder injector 26 under all conditions of operation. Alternatively, a portion of the fuel charge, and in fact the main fuel charge, may be injected into the intake port 18 by the auxiliary injector 28. In this case, injector 26 may form only a supplemental fuel injection means, supplying sufficient fuel to form the desired rich mixture in the center of the cylinder, while leaving the job of forming a richer or leaner mixture in the main portion of the cylinder to the auxiliary injector 28.

Figure 4:
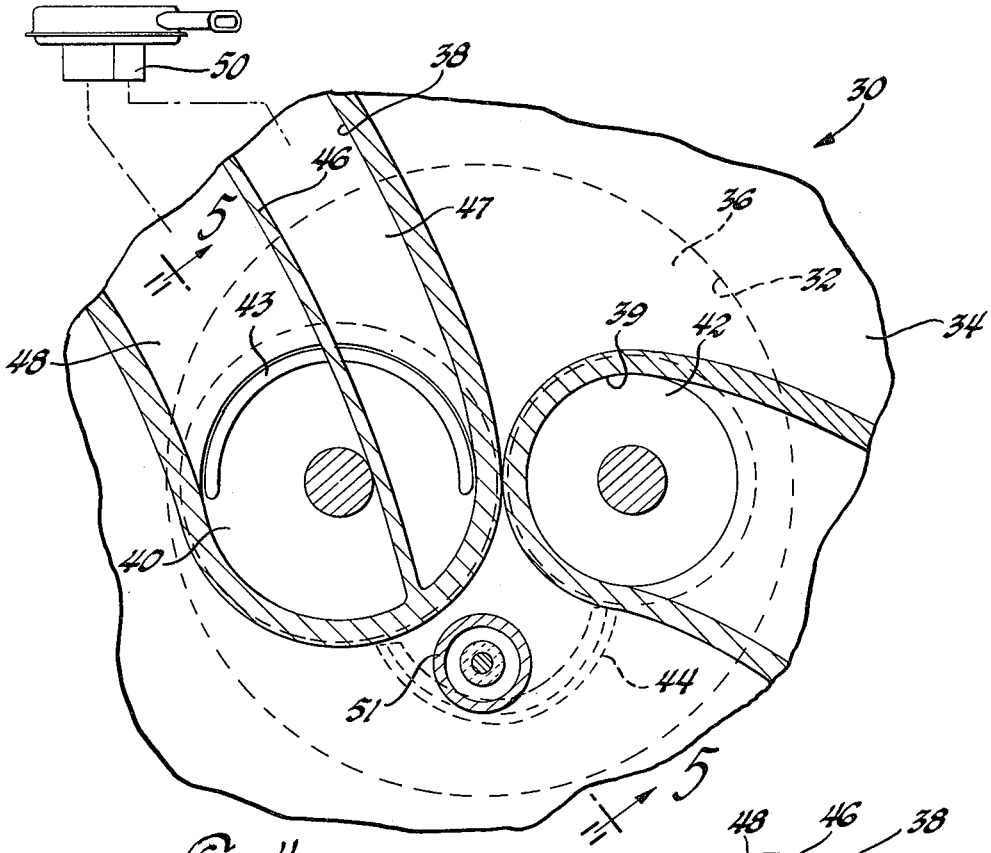
FIG. 4 is a cross-sectional view like FIG. 1, but showing an alternative embodiment of engine according to the invention.
Figure 5:
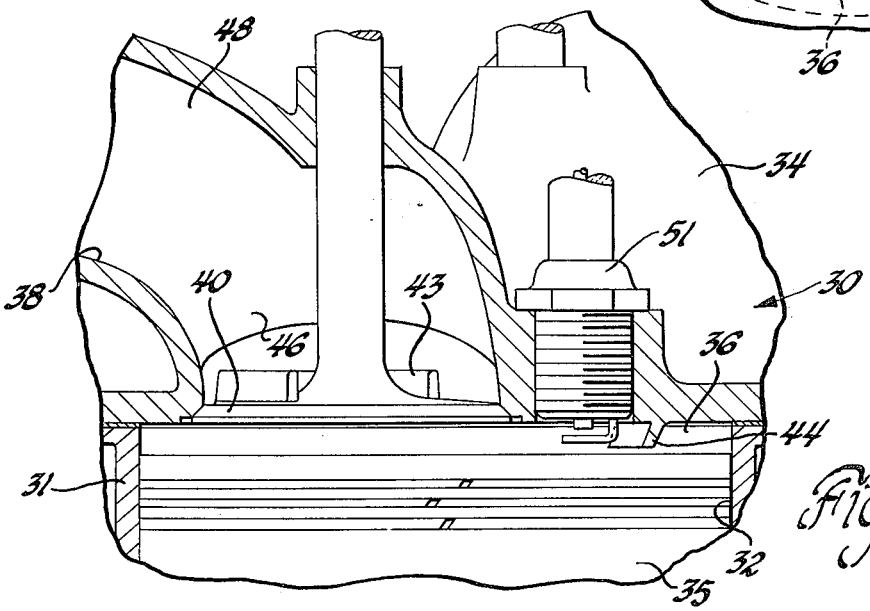
FIG. 5 is a transverse cross-sectional view through the combustion chamber and associated components of the engine of FIG. 4.

Referring now to FIGS. 4 and 5 of the drawings, there is shown an alternative engine embodiment according to the invention and generally indicated by numeral 30. Engine 30 includes a cylinder block 31, defining cylinders 32, closed by a cylinder head 34, and containing pistons 35, which together define combustion chambers 36, as indicated in respect of the first described embodiment.

Cylinder head 34 also defines intake and exhaust ports 38, 39 which are respectively controlled by intake and exhaust valves 40, 42 in the manner previously described. Intake valve 40 is provided with a swirl producing shroud 43 and a cylinder head 34 is provided with a downwardly extending mixture scoop or vane 44 in much the same fashion as indicated with respect to the first described embodiment.

The embodiment of FIGS. 4 and 5 differs from that of FIGS. 1–3 primarily in that the intake port 38 includes a dividing wall 46 that splits the port into separate rich and lean mixture passage portions 47, 48, respectively. A carburetor 50, or other suitable means, is provided for supplying a rich air-fuel mixture to passage portion 47 and a lean air-fuel mixture to passage portion 48. The amount of air-fuel mixture supplied to each portion and the air-fuel ratios of the various mixtures may, of course, be controlled as desired.

The scoop 44 is positioned within the combustion chamber so that it essentially separates the rich air-fuel mixture entering the combustion chamber through the intake passage 47 from the lean mixture entering from passage 48 and directs the rich mixture inwardly around the center core of the cylinder. The lean air-fuel mixture entering through passage 48 is in turn directed by the intake port outwardly of the scoop 44 in a swirling motion around the periphery of the cylinder. In this fashion, the mixture scoop or vane 44 aids in segregating the rich and lean charges of air-fuel mixture introduced in swirling pattern by the intake port 38.

As in the previous embodiment, a spark plug 51 is disposed in the cylinder head inwardly of the vane 44 and preferably adjacent thereto where it is in position to ignite the rich air-fuel mixture at the proper time.

Figure 6:
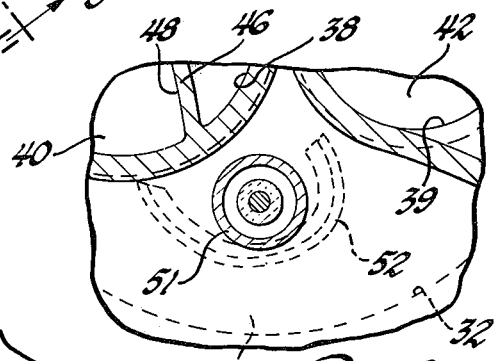
FIG. 6 is a fragmentary view illustrating an alternative mixture scoop arrangement for use in engines according to the invention.

Referring now to FIG. 6, there is shown an engine arrangement generally similar to that of FIGS. 4 and 5, but differing in that the shape of the rich mixture scoop or vane 52 is modified. In this embodiment, the curvature of the scoop is greater after it passes the spark plug so that the rich mixture is directed inwardly of the exhaust port to form a smaller swirling central pattern.

One purpose of this scoop design is so that hydrocarbon-rich quench products, which may remain along the inner surface of the scoop and the adjacent central portion of the cylinder head wall, will be more positively restricted from being swept out of the exhaust port when the exhaust valve opens during the piston exhaust stroke. In other respects, the function of the scoop 52 is much like that of the scoop arrangements of the previously described embodiments, and it should be understood that the modified vane arrangement of FIG. 6 could be utilized in the engine of FIGS. 1–3, as well as in that of FIGS. 4 and 5.

While the invention has been described by reference to certain preferred embodiments, it should be recognized that additional variations in design could easily be made within the scope of the inventive concepts disclosed. Accordingly, it is intended that the invention not be limited by the disclosed embodiments, but that it have the full scope permitted by the language of the following claims.

I claim:

1. The combination in a four-stroke cycle internal combustion engine of means defining a closed end cylinder a piston reciprocable in said cylinder and defining therewith a variable volume combustion chamber at said cylinder closed end inlet and exhaust ports connecting with said cylinder at said closed end inlet and exhaust valves respectively associated with said ports and operable to close and open their connections with said cylinder, said inlet port and its associated inlet valve being arranged to direct incoming air in a swirling motion around the axis of said cylinder, a scoop extending downwardly from said cylinder closed end toward said piston, said scoop being spaced between the axis and wall of said cylinder and curved in a manner generally parallel with the curvature of said wall from a point adjacent said inlet valve toward said exhaust valve in the direction of inlet air flow, thus separating the swirling air mass into central core and annular peripheral portions, a spark plug in said cylinder defining means and having a spark gap in said combustion chamber adjacent the inner side of said scoop in said central core portion and means to establish in said central core portion of the combustion chamber a rich combustible fuel-air mixture for ignition by said spark plug.

2. The combination of claim 1 wherein said mixture establishing means comprises a fuel injection nozzle in said combustion chamber and arranged to spray a stream of fuel directly on the side of said scoop which faces toward the cylinder axis, said rich mixture being formed by evaporation of liquid fuel from the hot surface of the scoop.

3. The combination of claim 1 wherein said mixture establishing means comprises means dividing said inlet port into first and second passages, said first passage being arranged to direct inlet gases passing therethrough primarily into said combustion chamber central core portion, said second passage being arranged to direct inlet gases passing therethrough primarily into said annular peripheral portion and means for providing a rich fuel-air mixture in said first passage.

* * * * *